United States Patent [19]

Dvorak et al.

[11] Patent Number: 4,681,061

[45] Date of Patent: Jul. 21, 1987

[54] BUTTON INDICATOR AND SWITCH ASSEMBLY

[75] Inventors: Robert F. Dvorak, Mount Vernon; Charles E. Netolicky, Cedar Rapids; Neil R. Palmer, Swisher, all of Iowa

[73] Assignee: Square D Company, Palatine, Ill.

[21] Appl. No.: 720,209

[22] Filed: Apr. 5, 1985

[51] Int. Cl.[4] ..... G08B 5/02

[52] U.S. Cl. ..... 116/279; 116/DIG. 28; 335/164

[58] Field of Search ..... 116/DIG. 28, 279, 283, 116/307, 324; 200/DIG. 25, 159 R, 314, 246, 330, 308, 340; 337/56, 91, 72, 79; 335/166, 17, 164

[56] References Cited

U.S. PATENT DOCUMENTS

| | | | |
|---|---|---|---|
| 2,062,259 | 11/1936 | Thomas | 116/DIG. 28 |
| 2,265,124 | 12/1941 | Andres | 200/314 |
| 2,270,950 | 1/1942 | Jackson et al. | 337/72 |
| 2,643,311 | 6/1953 | Giuffrida | 337/56 |
| 2,780,198 | 2/1957 | Low | 200/308 |
| 3,422,384 | 1/1969 | Filchak | 337/56 |
| 3,848,211 | 11/1974 | Russell | 337/64 |
| 4,251,289 | 2/1981 | Russel . | |
| 4,287,399 | 9/1981 | Wiechert | 200/340 |
| 4,466,042 | 8/1984 | Zylstra et al. | 361/115 |

*Primary Examiner*—Charles Frankfort
*Assistant Examiner*—W. Morris Worth
*Attorney, Agent, or Firm*—Larry I. Golden; Richard T. Guttman

[57] ABSTRACT

A flush mounted indicating button assembly and operating button assembly each connected to a cover having a pair of holes which receive identical buttons of the assemblies. Each button includes a circular head portion having a flat top surface and a circular base portion having a lesser diameter than the head portion which has a flat bottom surface and defines a collar portion at the bottom of the head portion. The base portion of each bottom is provided with a circumferential channel adjacent the bottom surface which carries a retaining ring. The indicator button is positioned within the hole by a leaf spring member which is connected to the bottom surface of the cover and includes an opening shaped and dimensioned to permit passage of the base portion while preventing passage of the head portion of the button. The opening is in registration with the hole in the cover and a helical coil encircles the base portion intermediate the leaf spring member and the retaining ring. The hole through which the operating button extends is provided with an annular lip adjacent the bottom surface of the cover with a coil spring captured between the collar portion of the button and the annular lip while the retaining clip is engaged with the bottom surface of the cover to prevent further upward movement of the button.

3 Claims, 5 Drawing Figures

BUTTON INDICATOR AND SWITCH ASSEMBLY

FIELD OF THE INVENTION

The present invention relates in general to activating and indicating buttons and more particularly to an effective, economical design to provide an electronic ground fault circuit breaker with a trip indication button and a test button.

BACKGROUND OF THE INVENTION

It is often desirable for a circuit breaker to have a trip indicating button which is ordinarily flush with or recessed within the circuit breaker cover and, upon tripping of the breaker for any of various reasons, is raised to extend above the cover and provide visual indication as to the tripped condition of the circuit breaker. Various means have been empolyed to provide this type of indication as, for example, shown in U.S. Pat. No. 4,251,789. This patent illustrates a common practice of connecting a button directly to a plunger which moves from a first position to a second position causing the button to move from a first position in which the button is flush or recessed from the cover or cap on the circuit breaker to a second position in which the button projects outward from the cover or cap of the circuit breaker. It is also desirable for a ground fault trip indicating circuit breaker to have a test switch which initiates simulation of a ground fault for testing purposes. A trip indicating solenoid and a test switch could be carried side by side by the base of the circuit breaker. It is believed desirable to provide and aesthetic and effective means, carried by the cover of the circuit breaker, for operating the test switch as well as indicating the position of, and resetting, the trip indicating solenoid.

SUMMARY OF THE INVENTION

The present invention is for use in an electronic ground fault circuit breaker having a ground fault test feature of the type shown and described in application Ser. No. 720,130 filed concurrently herewith by Robert F. Dvorak for a Self Contained Ground Fault Test Feature in Circuit Breaker which is assigned to the same assignee as the instant invention and the disclosure of which is hereby incorporated by reference.

The field accessible test initiation and trip indication features are accomplished by having a pair of identical molded buttons individually connected to the circuit breaker cover. These buttons are respectively aligned with a trip indicating solenoid plunger and a test switch which are carried within the base of the circuit breaker. Each button is provided with a circular head portion and a circular base portion having a lesser diameter than the head portion which provides a collar portion on the bottom of the head portion. Each base portion has a flat bottom surface which is engaged by either the solenoid plunger or the test switch. A circumferential channel on the button base adjacent the bottom surface secures a retaining ring which limits upward movement of each of the buttons. The test switch button and indicating button are carried in different manners in side by side relationship by the cover. A pair of holes are provided in the cover with one hole including an embossed section forming a lip on the bottom portion of the cover which surrounds the base portion of the button. The hole is thereby provided with a top portion having a greater diameter than the bottom portion. The test switch button passes through this hole and is retained by the retaining ring on the bottom of the cover while a coil compression spring encircles the bottom portion of the button, between the lip portion of the cover and the collar portion of the button. The top of the button is also flat and flush with a top portion of the cover.

An indicator button is retained in a single diameter hole by a cantilever spring connected to the bottom of the cover. The cantilever spring includes an opening through which the base of the button extends, however, the opening in the spring does not permit passage of the head portion of the button causing the collar portion to engage portions of the cantilever spring around the opening. A coil compression spring encircles the base portion of the button between the cantilever spring and the retaining ring. The top surface of this button is also flush with a top surface of the cover.

The present invention provides flush mounted operating and indicating means carried by the cover which requires use of two identical molded buttons, two identical compression springs, two identical retaining rings and a cantilever leaf spring.

It is an object of the present invention to provide economical operating and indicating means which allow for misalignment between the respective buttons and the associated test switch and solenoid.

Other features of the invention will be apparent to those skilled in the art from the following specification including the appended claims and the accompanying Drawings of the invention in which:

DESCRIPTION OF THE PREFERRED EMBODIMENT

Figure 3:
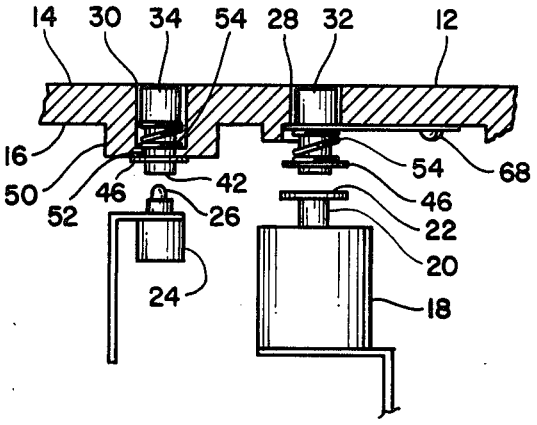
FIG. 3 is a partial side cross-sectional view of a cover showing the buttons mounted thereto and the associated test switch and solenoid during normal operation of the circuit breaker.
Figure 3A:
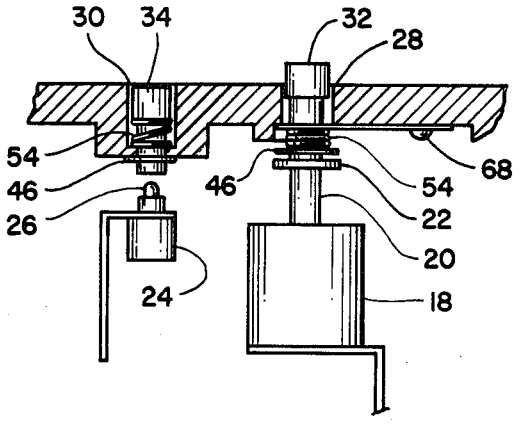
FIG. 3A is a partial side cross-sectional view of a cover showing the buttons mounted thereto and the associated test switch and solenoid when the circuit breaker has been tripped causing the solenoid plunger and associated indicator button to be raised.
Figure 4:
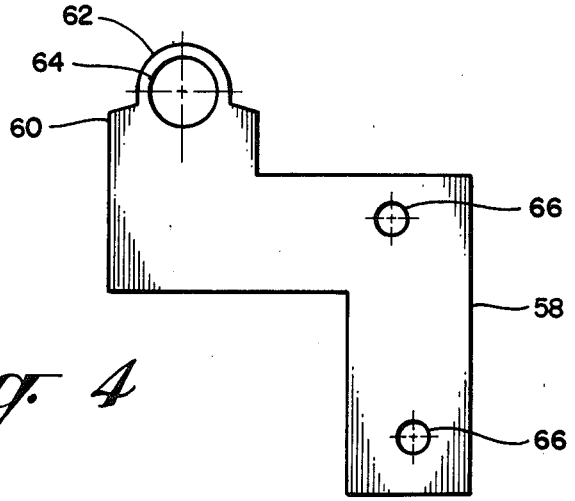
FIG. 4 is a top view of the cantilever spring.

As can best be seen in FIGS. 3 and 3A of the Drawings, the present invention relates to the provision of field accessible test initiation and trip indication for an electronic circuit breaker and, more particularly, is directed toward the button means used for such operations. The invention is utilized with an electronic circuit breaker having a casing which includes a molded cover 12 having a top portion 14 and a bottom portion 16. The cover is connected to a base of the circuit breaker which is not shown. The circuit breaker may be provided with a trip indicating solenoid 18 which is activated by an electronic trip unit in response to a ground fault condition. The solenoid includes a plunger 20 having a generally flat top surface 22. A self contained ground gault test feature as shown and described in the aforereferenced application by Dvorak provides a test switch 24 carried within the base and has an activating knob 26 which, when depressed, activates the ground fault test feature causing the circuit breaker to be tripped and the trip indicating solenoid to be activated by the electronic trip unit which may be of the type available or as described in copending application Ser. No. 720,235 for a Micro-Computer Based Electronic Unit For A Circuit Breaker owned by the same assignee as the present application and which is incorporated herein by reference. The trip indicating solenoid and test switch may be carried in any conventional manner within the base of the circuit breaker, preferably in generally close relationship to each other.

The circuit breaker cover is formed of a molded material such as bakelite and is provided with a first hole 28 and a second hole 30 in generally side-by-side relationship and positioned to be respectively aligned in registration with the plunger and activating knob which are carried within the base of the circuit breaker.

A pair of identically molded buttons 32 and 34 extend through the respective holes 28 and 30. The trip indicating solenoid is connected to the electronic trip unit of the circuit breaker and is activated by the trip unit in response to a sensed ground fault condition to release the plunger which is driven upwards to push the indicator button 32 above its flush position with the cover indicating that the circuit breaker has been tripped as a result of a ground fault condition.

The other button 34 is aligned to operate the test switch for activating a test function within the circuit breaker as described in the earlier referenced application. The test function simulates a ground fault condition which causes the trip unit to activate a trip solenoid which trips the circuit breaker and also activates the trip indicating solenoid which releases the plunger causing the indicator button to be raised.

Figure 2:
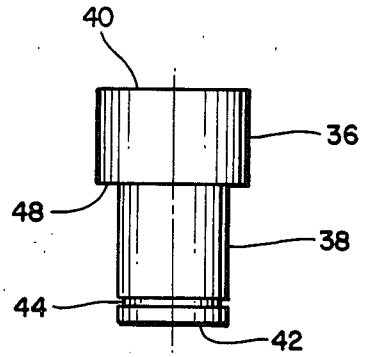
FIG. 2 is a side view of the button.

The buttons 32 and 34 are identical and may be formed from a 30% glass filled nylon material or any other suitable material. As shown in FIG. 2 of the Drawings, each button is provided with a circular head portion 36 and a circular base portion 38 having a reduced diameter from the head portion. The head has a flat top surface 40 which is positioned in flush relationship with the top portion 14 of the circuit breaker cover or may be recessed as will be hereinafter further described. The base portion of the button includes a flat bottom surface 42 which will engage either the trip indicating solenoid plunger or the activating knob of the test switch. A circumferential channel 44 is provided on the button base adjacent the bottom surface 42 to secure a retaining ring 46 which as later addressed, limits upward movement of each of the buttons. The head is provided with an annular collor portion 48 at the point where the diameter of the button is reduced.

Hole 30 is formed in a portion of the cover 12 which includes an embossed section 50. The embossed section includes an annular lip 52 at the bottom end of the hole. The diameter of hole 30 is sufficiently large to receive head 36 of button 34, with the annular lip 52 reducing the diameter of hole 30, while permitting the base portion 38 of the button to be received therethrough. The button 34 is positioned with its top surface 40 generally flush with the top surface 14 of the cover while the base portion 38 extends past the annular lip 52 below the bottom surface 16 of the cover, positioning flat bottom surface 42 directly above and proximate to activating knob 26.

A coil spring 54 encircles the base portion 38 and is retained intermediate the collar portion 48 of the button and the annular lip 52. Coil spring 54 biases the button in an upward direction while the retaining ring 46, secured within channel 44, limits the upward movement of button 34 with respect to the cover by engaging the bottom surface 16 of the cover adjacent the annular lip 52 of embossed section 50. The spring 54 is set to return the top surface 40 of the button in generally flush relationship with the top surface 14 of the cover while also permitting the button to be depressed causing surface 42 to operate activating knob 26.

Hole 28 is provided in cover 12 with a uniform diameter sufficient to receive the head portion 36 of indicator button 32. Indicator button 32 is carried by the cover through the use of a cantilever spring member 56. The cantilever spring includes a generally L-shaped mounting section 58 with an extending leaf portion 60 having a semi-circular end portion 62 forming a partial border around a circular opening 64 which is sized to receive the base portion of the button while not being able to receive the head portion of the button. The mounting section 58 includes a pair of apertures 66 which respectively receive a pair of rivets 68 or some other fastening device which connect the cantilever spring to the bottom surface 16 of the cover 12.

Figure 1:
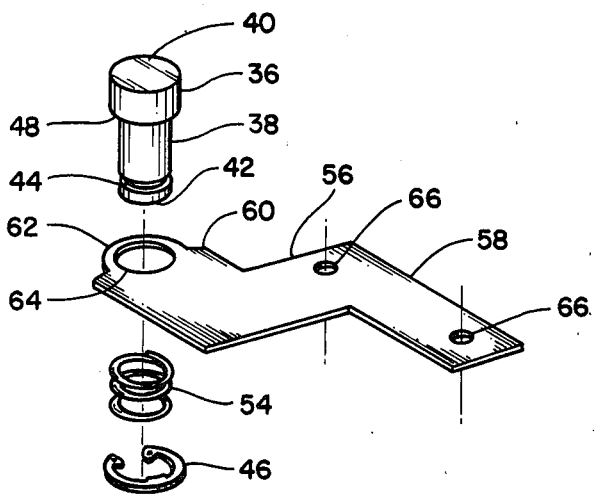
FIG. 1 is an exploded perspective view showing the button, the cantilever spring, the coil compression spring and the retaining ring.

As shown in FIGS. 1, 3 and 3A, indicator button 32 extends through opening 28 with the base portion 38 extending through the circular opening 64 of the cantilever spring which is secured at its mounting section 58 to the underside of cover 12. The collar portion 48 of the button rests upon the portions of the cantilever spring around the circular opening 64 preventing the button from passing through opening 28 in the cover. The height of the head portion 36 of the button is substantially equal to or slightly less than the thickness of the cover 12 at the location of opening 28, thereby providing a button which is substantially flush with or slightly recessed from the top surface 14 of cover 12. The retaining clip 46 is secured within channel 44 while coil spring 54 encircles the base portion 38 of the button between cantilever spring 56 and retaining clip 46, thereby biasing the indicator button 32 toward its flush or recessed initial position. The flat bottom surface 42 of the button is aligned with and spaced a predetermined distance from the flat surface 22 of plunger 20 such that the indicator button is raised from the initial position shown in FIG. 3 to a first position shown in FIG. 3A in response to extension of plunger 20 resulting from a sensed ground fault trip condition by the circuit breaker. The head portion 36 of the indicator button 32 may be colored or otherwise identified to readily indicate the trip position of the circuit breaker.

After the indicator button has been moved to the trip indicating first position as shown in FIG. 3A, the plunger may be reset by depressing the indicator button 32 causing bottom surface 42 to press against the top surface of the plunger 22, pushing the plunger towards its reset position. As the button is depressed, the collar portion is moved back into engagement with the cantilever spring 58 as the base of the button is passed downward through opening 64. Coil spring 54 is released from a compressed position as shown in FIG. 3A to an expanded position as shown in FIG. 3 as the button passes to its initial position. Once the collar portion 48 engages the cantilever spring around the circular opening 64, the button must be pressed further to a second position to move the plunger to its reset position which is spaced the predetermined distance from the bottom of the button when the button is in its initial position. This is accomplished by deflection of the leaf portion 60 of the cantilever spring until plunger 20 is moved to its reset position by indicator button 32. Upon release of the button, cantilever spring 56 returns the indicator button to its initial flush position as shown in FIG. 3 of the Drawings.

Upon sensing a ground fault of sufficient magnitude, the trip unit will trip the circuit breaker and activate the trip indicating solenoid 18 which releases plunger 20, moving the plunger from the position shown in FIG. 3 to the position shown in FIG. 3A, causing compression of coil spring 54 and raising the trip indicator button to its trip indicating position.

While the invention has particularly been shown and described with reference to a preferred embodiment, it will be understood by those skilled in the art that variations in form, construction and arrangements may be made therein without departing from the spirit and scope of the invention, all such variations are intended to be covered in the appended claims.

We claim:

1. A trip indicator and reset assembly for a circuit breaker having a trip indicating solenoid with a plunger movable between a trip position and a reset position comprising:

a cover for said circuit breaker having a top surface and a bottom surface and a hole in axial alignment with said plunger;

a button separable from said plunger having a head portion and a reduced diameter base portion, said head portion being shaped and dimensioned to pass through said hole and having a collar portion adjacent said base portion;

a leaf spring having a mounting portion secured to said bottom surface of said cover and having an extending leaf portion, said leaf portion including an opening in registration with said hole, said opening shaped and dimensioned to permit passage of said base portion of said button while preventing passage of said head portion of said button; a retaining ring secured to said base portion of said button; and a coil spring encircling said base portion of said button intermediate said leaf spring member and said retaining ring, said coil spring biasing said button toward a position having said collar portion engaged with said leaf spring, said leaf spring resiliently positioning said button at an initial position within said hole while permitting said button to be moved to a first position indicating a trip condition in response to said plunger moving to said trip position and also permitting said button to be moved in an opposite direction past said initial position to a second position to move said plunger to said reset position, said leaf spring resiliently biasing said button towards said initial position in response to said button being moved between said initial position and said second position.

2. A trip indicator and reset assembly as claimed in claim 1 wherein said cover has a predetermined thickness at said hole and and said head portion of said button having a height substantially equal to said predetermined thickness.

3. A trip indicator and reset assembly as claimed in claim 2 wherein said head portion of said button includes a flat top surface and said base portion of said button includes a flat bottom surface.

* * * * *